US005199786A

United States Patent [19]

Baliozian

[11] Patent Number: 5,199,786

[45] Date of Patent: Apr. 6, 1993

[54] MODULAR ELEMENT FOR A LIGHTING DEVICE

[76] Inventor: Mardick Baliozian, 175 E. Delaware Pl., Chicago, Ill. 60611

[21] Appl. No.: 867,053

[22] Filed: Apr. 10, 1992

[30] Foreign Application Priority Data

Jun. 12, 1991 [FR] France ..... 91 07124

[51] Int. Cl.[5] ..... F21V 7/00

[52] U.S. Cl. ..... 362/297; 362/247; 362/298; 359/855

[58] Field of Search ..... 362/241, 243, 247, 296–301; 359/855; 126/438

[56] References Cited

U.S. PATENT DOCUMENTS 4,222,368 9/1980 Rost et al. ..... 126/438
4,423,926 1/1984 Stolpin ..... 126/438
4,587,951 5/1986 Townsend et al. ..... 126/438
4,796,168 1/1989 Peterson ..... 362/247
4,848,320 7/1989 Burns et al. ..... 126/438
4,947,305 8/1990 Gunter, Jr. .

FOREIGN PATENT DOCUMENTS 359163 10/1980 Australia .
3634156 4/1988 Fed. Rep. of Germany .

*Primary Examiner*—Carroll B. Dority
*Attorney, Agent, or Firm*—Young & Thompson

[57] ABSTRACT

A modular reflector element for a lighting device houses an elongated light-source such as a U-shaped cylindrical tubular lamp. The reflector element has a reflecting surface on the front face which is directed towards the light source, a series of ribs on the rear face, and lateral edge members formed by end ribs which are rearwardly inclined towards each other and with respect to a front plane.

16 Claims, 4 Drawing Sheets

MODULAR ELEMENT FOR A LIGHTING DEVICE

BACKGROUND OF THE INVENTION

1. Field of the Invention

The invention relates to a modular reflector element for a lighting device which is particularly well suited to the fields of photography, motion pictures, television, video and the entertainment industry as a whole.

2. Description of the Prior Art

The lighting appliances employed in these fields are usually one of the following types :

1. Rigid boxes formed by an assembly of sheets of metal or of molded or shaped plastic, the interior of the box being usually painted white.

2. Flexible boxes that can be dismantled, the box being formed by thin sheets of plastic or of textile fabric stretched over rigid or semi-rigid rods formed to the desired shape.

3. Semi-rigid light boxes that can be dismantled, the box being made of semi-rigid sheets of greater thickness, the rigidity of which is ensured by the geometrical structure after three-dimensional shaping.

4. Light boxes for viewing by transparency, of molded plastic or metal with a light-diffusing surface placed in front of an array of fluorescent lamps.

5. Suntanning appliances equipped with ultraviolet lamps each provided with a parabolic reflector or electicaly shaped placed within a casing having an open face.

These appliances are subject to a certain number of disadvantages and in particular:

the appliances of types 1 to 4 are not equipped with bright metallic optical reflectors and their lighting efficiency is consequently low;

no appliance is equipped with means for varying the angle of illumination since they are not provided with slots for supporting honeycomb spotlight grids;

no appliance is provided with means so designed as to insert in the light boxes removable accessories such as color filters, diffusers, grid spots or the like;

no appliance is provided with means for removably and pivotally fixing accessories such as light-absorbing or light-reflecting flaps around the front face of the appliance or for adding three-dimensional light-reflecting accessories which are intended to increase the light flux while reducing the angle of illumination;

all the appliances are manufactured with surfaces having predetermined dimensions for each type of box.

When boxes of different sizes are desired, it is therefore necessary to produce parts having different dimensions by making use of tools which also have different dimensions. This consequently results in increased tooling and inventory costs;

in the case of appliances of type 5, the assembly of a number of reflectors and mounting of the reflectors within the box by mechanical means are complex, time-consuming and costly operations;

in the case of appliances of types 1 to 4, the ratio of thickness to the width of the boxes is very high.

Moreover, no provision is made in these appliances for:

fixing the appliances directly on horizontal or vertical metallic tubes such as those employed in movie and television studios for supporting light sources;

fixing the appliances in a removable and adjustable manner at their center of gravity on a pivoting and rotating support when they are placed on a stand, for example;

mounting the light box in a detachable and adjustable manner at the rear end thereof so that it can be held at a point which is close to its center of gravity;

permitting rotation of the light box about its rear axis of assembly in order to produce rotation of its front face, which is necessary when making use of a polarizing filter in order to control the angle of polarization;

holding a light-reflecting umbrella at its axis while passing it into the central zone of the light source;

coupling a number of light boxes in adjacent relation either stationarily or by causing the light boxes to pivot with respect to each other;

holding adjustable, articulated or flexible arms of small size for the purpose of carrying accessories such as filters or diffusers in front of the light box;

mounting lenses or an objective with a view to projecting images of anything that can be placed in the front section of the light box in order to project different types of light;

opening the top or the sides of the light box in order to permit insertion in the box of different accessories in slots designed for this purpose;

removably mounting on the front face of the light box and around said face additional accessories such as light-reflecting or absorbing flaps, lenses of different types, or a concave three-dimensional light-reflecting system for increasing the light intensity by concentrating it within a smaller angle;

mounting in different ways the reflector elements which are employed for each lamp:

in a fixed and parallel manner, in a fixed manner, with the front faces of the reflectors at different angles, in a pivotal manner in order to vary the angular relationships of the reflectors, in either a concave or convex manner.

The object of the present invention is to overcome the disadvantages of existing lighting appliances, to provide a solution to existing requirements and to permit simple construction of a lighting device by means of modular elements.

SUMMARY OF THE INVENTION

The invention relates to a modular reflector element for a lighting device and to a lighting device comprising at least one modular element of this type.

In accordance with the invention, the modular reflector element for a lighting device houses an elongated light source such as a cylindrical tubular lamp having a U-shape or the like.

The modular reflector element has a reflecting surface on the front face which is directed towards the light source, a series of ribs on the rear face, and lateral edge members.

Said lateral edge members are formed by end ribs and are rearwardly inclined towards each other and with respect to a front plane.

In accordance with the invention, the lighting device comprises a light source and at least one modular reflector element. The device comprises in addition at least one framing wall having a base in which is formed a fixing groove and having on the side nearest the light source a surface which is adapted to carry ribs for holding or inserting accessories.

DETAILED DESCRIPTION OF THE INVENTION

Figure 1:
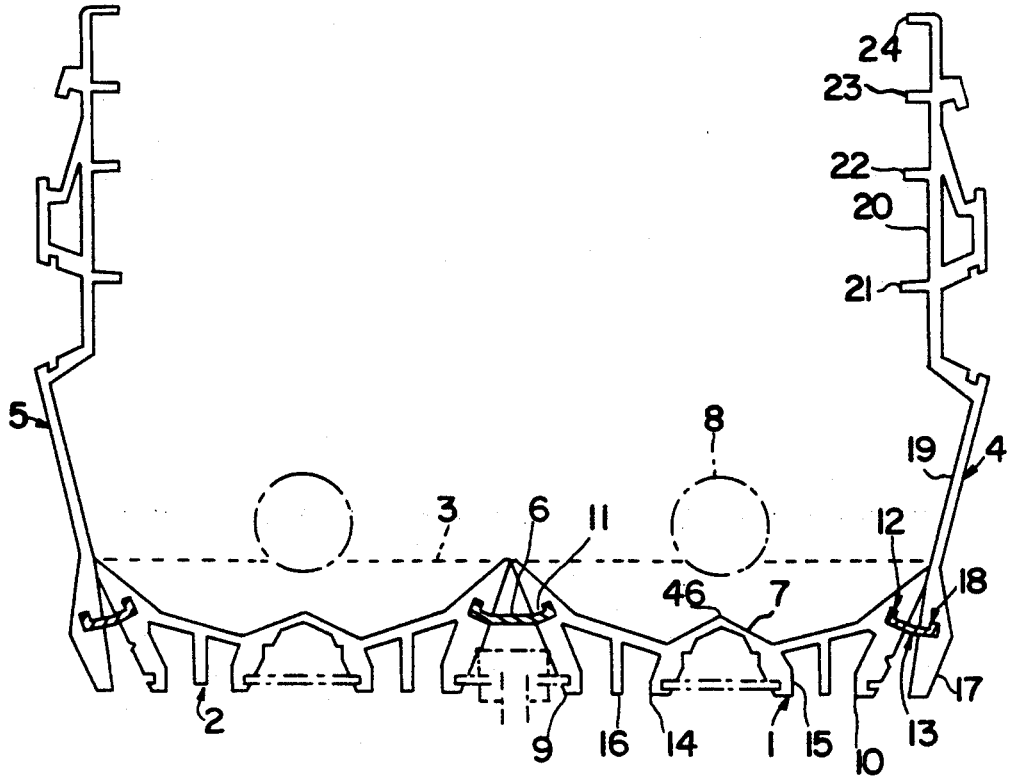
FIG. 1 is a sectional view taken at right angles to the longitudinal axis and illustrates one example of construction of a lighting device in accordance with the invention and comprising two reflector elements aligned on the same front plane.

Referring to the accompanying drawings, there is shown a light box essentially constituted by two reflector elements 1, 2 so arranged as to be aligned on the same front plane 3 and by two raised framing walls 4, 5 which extend substantially at right angles to the front plane 3.

The two reflector elements 1 and 2 are contiguous and joined together by means of a connecting strip 6 or a series of connecting members adapted to cooperate with grooves carried by the reflector elements.

Each reflector element 1, 2 is designed in the form of an extruded sectional member having a reflecting surface 7 on its front face, namely the face directed towards the light source which is represented by a tubular lamp 8, the rear face of said sectional member being provided with a series of ribs.

The end ribs constitute the lateral edge members 9, 10 of the reflector elements. These edge members have slots or grooves 11, 12 which are intended to receive, for example, the connecting strips 6 between two reflector elements 1, 2 or the connecting strips 13 between a reflector element 1, 2 and a corresponding framing wall 4, 5. The lateral edge members 9, 10 of the reflector elements are rearwardly inclined towards each other and with respect to the front plane 3.

Other ribs 14, 15 are provided with grooves and form a cavity between them so as to permit attachment of the reflector element itself or of the light box to a rear support or the attachment of an accessory to the reflector element. A similar cavity is located between two contiguous reflector elements.

Finally, other ribs 16 are provided solely in order to perform the function of a radiator.

The framing walls 4, 5 each have a base 17 in which is formed a groove 18 for the purpose of attaching said base to an adjacent reflector by means of the connecting strip 13. Cavities which are similar to those of the reflector elements or of different shape are formed in the outer face of the framing wall in order to permit the possibility of fixing a support therein and adjusting said support by sliding it until the center of gravity of the light box is found. These cavities may also serve to couple two light boxes by making use of conventional means. Said cavities also make it possible to fix accessories on the light box by means of articulated or flexible and adjustable arms.

The inner face of the framing walls 4, 5 is provided with different portions which correspond to different functions.

In the first place, the surface 19 located near the light source is advantageously inclined and has high reflecting power in order to reflect in the forward direction the light which comes directly from the lamp 8 or which has already been reflected from the reflector element 1. The surface 20 then extends at right angles to the front plane 3. This surface 20 carries a number of ribs such as those designated by the references 21, 22, 23, 24. An accessory such as a spotlight grid can be held between the first two ribs 21, 22. Accessories such as a diffuser or a color filter can be inserted on the one hand between the ribs 22 and 23 and on the other hand between the ribs 23 and 24. It is also possible to insert therein a transparent, translucent or opalescent plate of glass or of plastic, especially when the light box is employed for examining x-ray drawings or color transparencies, for example. Each framing wall is constituted by at least one sectional strip.

It is an advantage to ensure that the spacing of ribs such as the ribs 22 and 23 can be adjusted by means of one or a number of tapped right-angle members each fixed by means of one or a number of screws slidably fitted in one or a number of oblong slots.

In an alternative embodiment (not shown in the drawings), a frame can be provided for supporting accessories. This frame is adjustable both in position and spacing within said ribs by means of screws adapted to cooperate with oblong slots adjacent to or formed in said ribs.

The grooves 11, 12 of the reflector elements 1, 2 and the grooves 18 of the framing walls are capable of receiving different forms of connecting strips or connecting members according to the relative inclination to be given to the reflector elements and to the framing walls. For the purpose of inserting accessories in the light box, it is preferable to ensure that the framing walls are perpendicular to the front face 3 of the reflecting surface.

Figure 2:
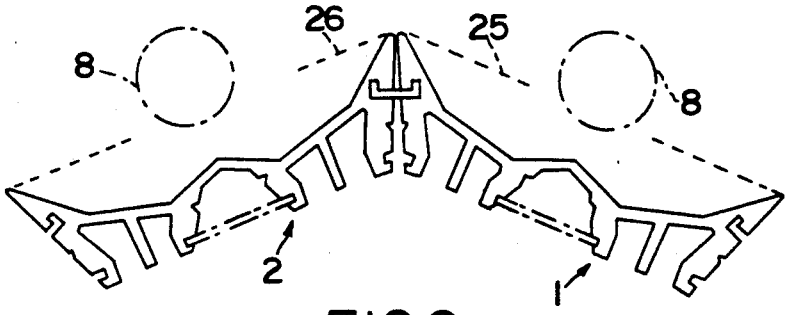
FIG. 2 is a transverse sectional view of an arrangement of two reflector elements for the purpose of forming a convex reflecting surface.

In FIG. 2, two reflector elements 1, 2 are so arranged that their front planes 25, 26 make an obtuse angle which is open towards the rear or in other words constitute a convex reflecting surface.

Figure 3:
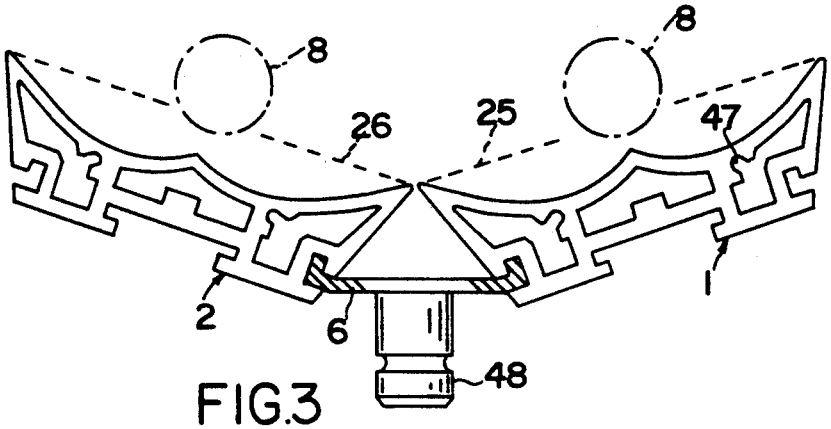
FIG. 3 is a transverse sectional view showing an arrangement of the two reflector elements for the purpose of forming a concave reflecting surface.

FIG. 3 shows on the contrary that they constitute a concave reflecting surface. In this alternative embodiment, the reflector elements 1, 2 are represented with a reflecting surface having a curvilinear crosssection. Their structure is also designed differently while retaining the same general principle of an extruded shape. In order to maintain the two elements 1 and 2 in a stable relative position, provision is made for sheaths 47 which are intended to receive self-tapping screws. Small end-plates are placed at the ends of the reflector elements 1, 2 and screws are passed through said end-plates in order to ensure rigidity of the entire assembly.

Moreover, the connecting strip 6 is so designed as to receive a fixing head 48 which can be placed opposite to the center of gravity of the lighting device. Said fixing head can be attached to a pin which serves as an axial support so that the device may accordingly be oriented by rotation about the pin.

Figure 4:
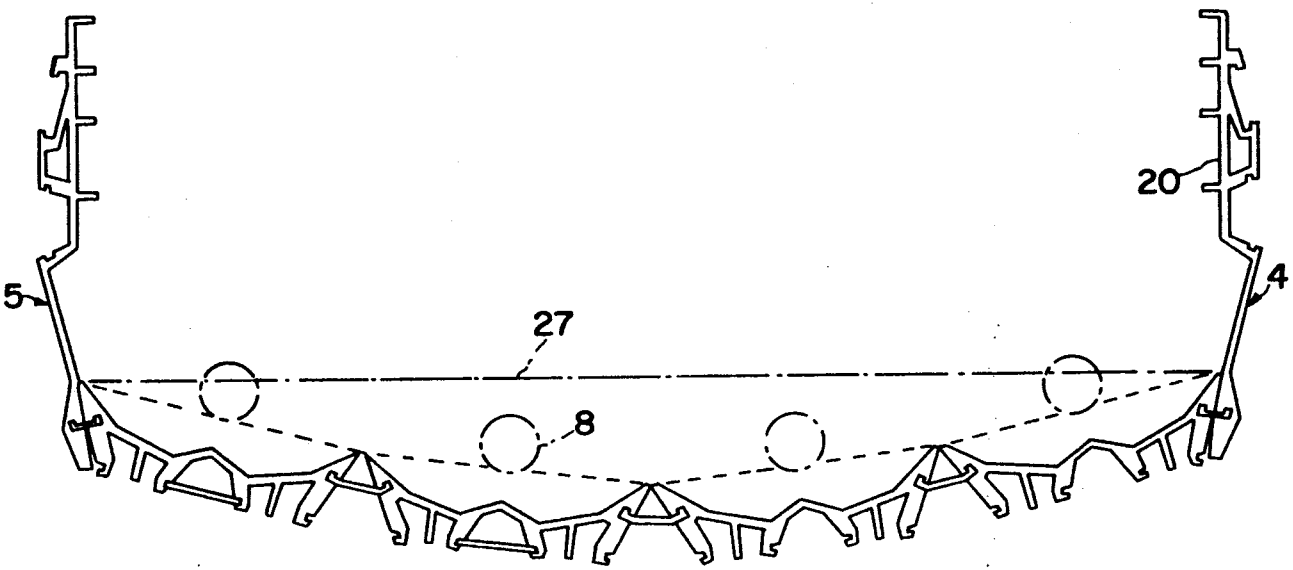
FIG. 4 is a transverse sectional view which is similar to FIG. 1 and shows an example of construction of a lighting device made up of four reflector elements which constitute a slightly concave reflecting surface.

In FIG. 4, provision is made for four reflector elements constituting a slightly concave reflecting surface and the framing walls 4, 5 or at least their surfaces 20 are parallel to each other, said surfaces 20 being adapted to carry the ribs which are intended to receive the accessories to be placed parallel to the general front plane 27.

Light boxes in accordance with the invention can have a wide range of different shapes whether open or closed such as, for example, a square shape, a hexagonal shape, an octogonal shape and so on.

Figure 5B:
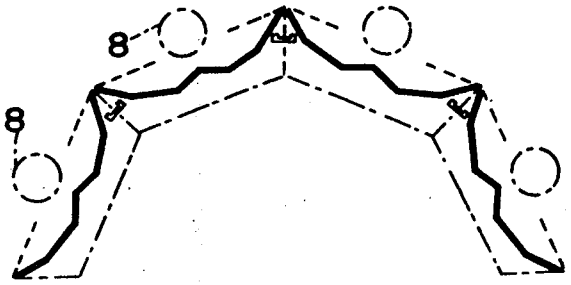
FIG. 5B is a transverse sectional view which illustrates an arrangement of the four reflector elements for the purpose of forming a substantially semi-cylindrical convex reflecting surface.
Figure 5A:
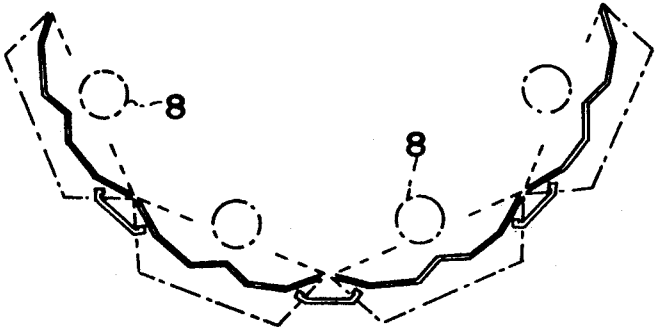
FIG. 5A is a transverse sectional view illustrating an arrangement of the four reflector elements for the purpose of forming a substantially semi-cylindrical concave reflecting surface.

In FIG. 5A, the reflector elements are so arranged as to be in convergent relation. In FIG. 5B, they are divergent. In both FIG. 5A and FIG. 5B, only four reflectors are illustrated but they can be six or eight in number and constitute a generally cylindrical reflecting surface.

Figure 6:
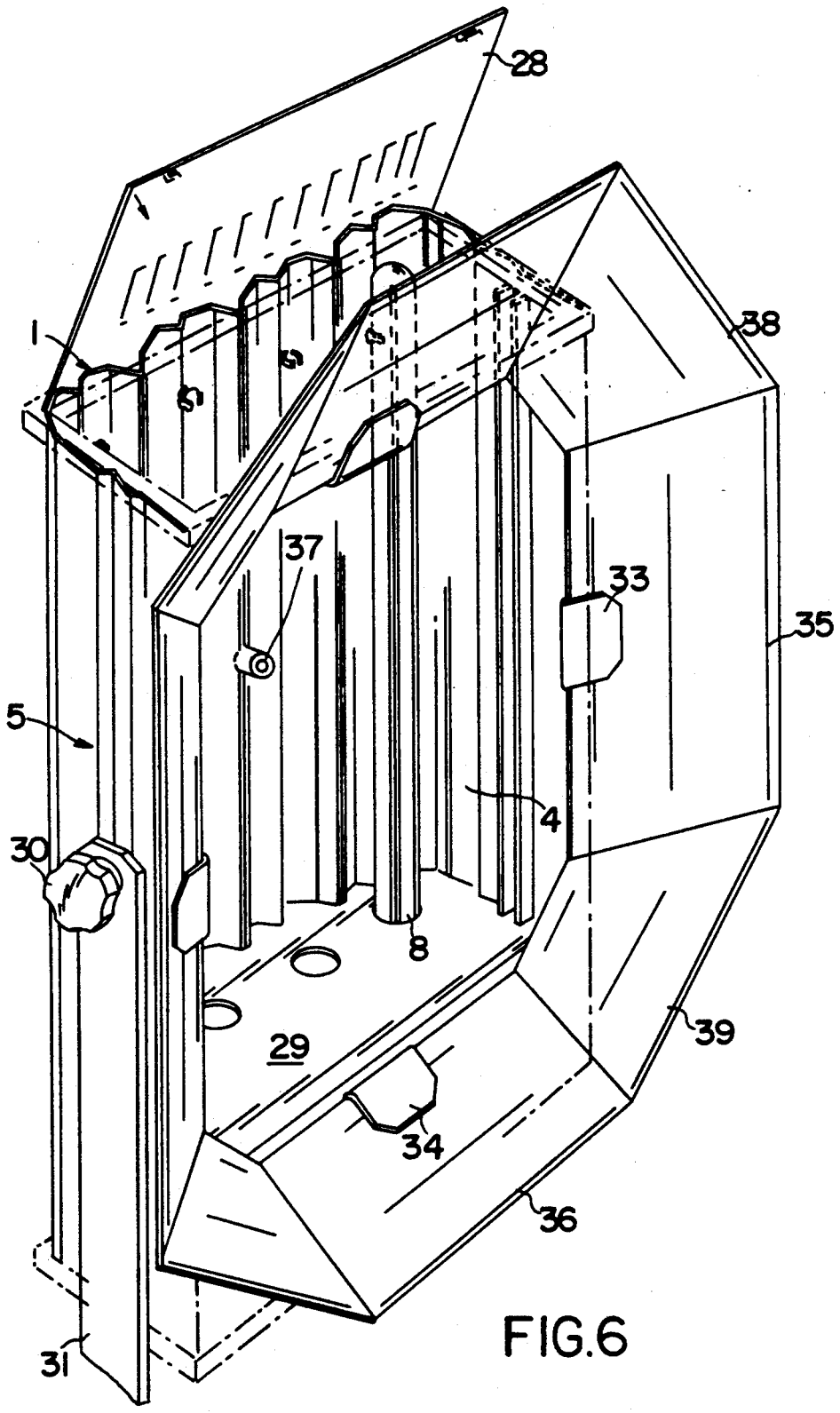
FIG. 6 is a perspective view of a lighting device in accordance with the invention and comprising four reflector elements.

In FIG. 6, there is shown a lighting device in accordance with the invention in which provision is made for four reflector elements each equipped with a U-shaped tubular lamp. The framing walls 4 and 5 constitute two sides of the light box. The top side 28 is pivotally mounted on its hinge so as to permit insertion of accessories between the grooves of the framing walls 4 and 5. The bottom side 29 delimits the portion of the light box which houses the electrical connections, the sockets for the tubular lamps and the electrical connection accessories.

Figure 8:
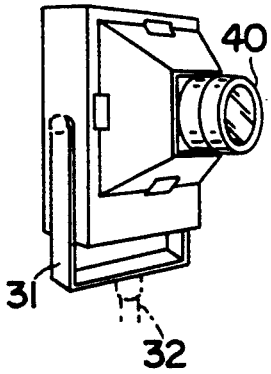
FIG. 8 is a perspective view of a lighting device in accordance with the invention and equipped with an additional mount with a projection objective.

Provision is made on the outer faces of the framing walls 4, 5 for two pivots such as 30 which serve to fix a yoke 31. Said yoke is in turn rigidly fixed to a support 32 (shown in FIG. 8) in order to support the lighting device in a state of equilibrium. Thus the axes of rotation which pass through the pivots and through the support 32 both pass through the center of gravity of the device.

Figure 7:
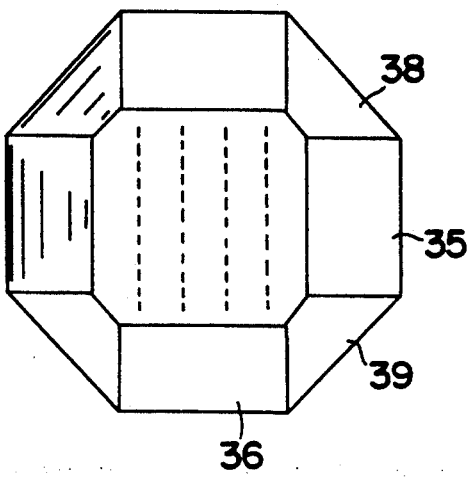
FIG. 7 is a front view of a lighting device in accordance with FIG. 6 with corner flaps.

The lighting device in accordance with the invention carries articulated accessory supports on the free edges of its front opening. Said supports can be clamps 33, 34 which are usually capable of pivoting. The accessories 35, 36 can be reflecting flaps, light-absorbing flaps, diffusers, color filters, a light-reflecting box (FIG. 7), a mount for a lens or objective 40 (FIG. 8), screens having irregular cut-out portions and known as gobos or the like.

In the central zone of the reflecting surface, a through-tube 37 is provided for the purpose of holding the stick of an umbrella reflector or diffuser.

In the corners of the front opening of the lighting device of FIG. 6, provision can be made for detachable and orientable flaps such as those designated by the references 38 and 39. Said corner flaps are intended to complete a light-reflecting box as shown in the front view of FIG. 7.

Figure 9:
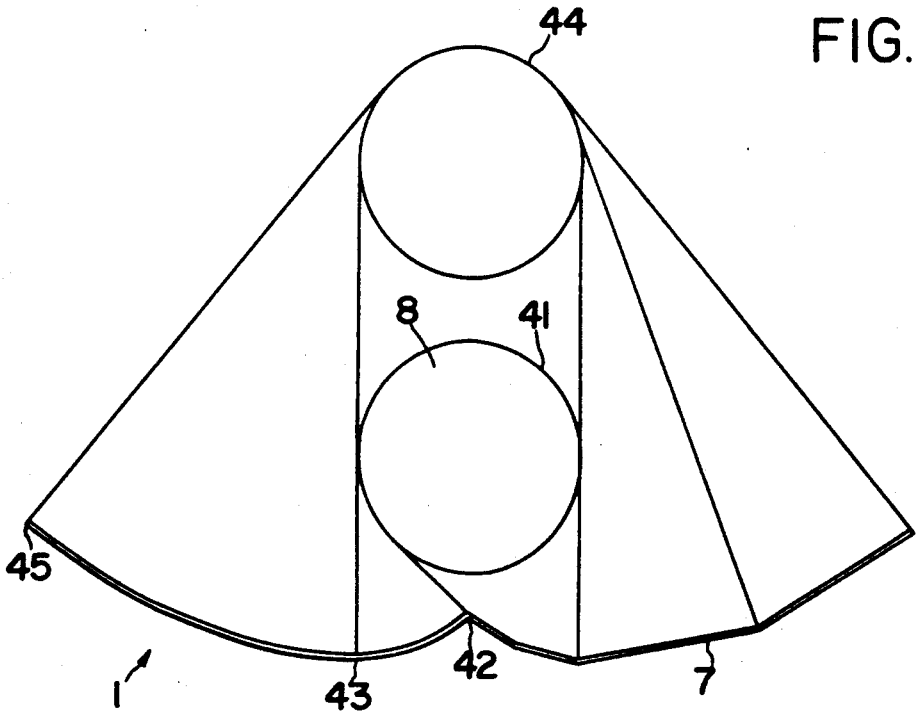
FIG. 9 is an enlarged transverse sectional view of a reflector element showing on one side an example of construction of a convex broken-line profile and, on the other side, an example of construction of a convex curved-line profile.

It is apparent from FIG. 9 that a reflector element 1 can have a curved-line profile or a broken-line profile. The front surface 7 of the reflector element is intended to reflect the light originating from the tubular light source 8 in such a manner as to prevent light from being reflected back to the source 8 itself. The light which comes from the source 8 is reflected once or a number of times in order to be returned in the forward direction. The reflecting surface 7 can be either curved or ridged.

When said surface 7 is curved, its profile, in the cross-section of FIG. 9, is an involute of the curve 41 which limits the source 8.

In the case of a light source consisting of a U-tube, a distinction should be made between two portions of profile: the first portion between the arris 42 and the point 43 corresponding to the tangent to the two circles 41 and 44, the second portion between the point 43 and the external edge 45 of the reflector. In the first portion, the profile is for example an involute of the circle 41 but is an involute of the circle 44 in the second portion. In both cases, a tangent to the circle is perpendicular to the profile. All the light which comes from the tube 8 will be oblique with respect to the tangent to the circle and will be reflected beyond this tangent without being able to return to the tube.

As an advantageous feature of the invention, the two portions of profile are so determined as to give a substantially circular shape to each portion, the radius of the second circular arc 43 to 45 being of greater length than the radius of the first circular arc 42 to 43.

In the case of the broken-line profile, this broken line is an approximation of the above-mentioned curved line and the results are similar.

In both cases, the reflector element 1 has the shape of a trough in which a projecting portion 46 (shown in FIG. 1) is formed along the longitudinal center line of the trough. Said projecting portion is disposed directly opposite to the axis of the tubular lamp 8 and is V-shaped, the opening of the V being directed towards the rear. With respect to the longitudinal center line, the reflector element is made up of two symmetrical portions each corresponding to a half-reflector.

The reflector elements as well as the framing walls are advantageously made of extruded aluminum alloy but other products or production means may be employed. The same sectional strips may be employed without any need to consider their length. It is not necessary to provide special tool equipment since the sectional strips are cut to the required length according to the dimensions of the box: the connecting strips can be bent sheetmetal strips or extruded sectional members.

The width of the light boxes may vary without involving tooling or storage costs and without having any influence on the depth of boxes in view of the fact that it is possible to fix thereon as many modular reflector elements as may be necessary in order to obtain the desired width.

What is claimed is:

1. A modular reflector element for a lighting device, said reflector element having a front face, a rear face, and being intended to house an elongated light source such as a cylindrical tubular lamp having a U-shape, said reflector element being provided with a reflecting surface on the front face which is directed towards the light source, with a series of ribs on the rear face and with lateral edge members, wherein the lateral edge members are formed by end ribs and are rearwardly inclined towards each other and with respect to a front plane.

2. A reflector element according to claim 1, wherein the ribs forming the lateral edge members have slots or grooves designed to receive connecting strips.

3. A reflector element according to claim 1, wherein ribs on the rear face have grooves and delimit between them a cavity designed to receive a fixing element.

4. A reflector element according to claim 1, wherein ribs on the rear face serve as a radiator.

5. A reflector element according to claim 1, wherein ribs of the series located on the rear face of said element define sheaths which are intended to receive self-tapping screws.

6. A modular reflector element according to claim 1, wherein the reflector element is symmetrical with respect to its longitudinal center line.

7. A modular reflector element according to claim 1 for receiving a U-shaped tubular lamp, wherein the reflecting surface is provided on the front face with two portions having a predetermined curved or broken-line profile, each portion being of substantially circular shape.

8. A lighting device comprising a light source, and at least one modular reflector element comprising in addition at least one framing wall having a base in which is formed a fixing groove, said framing wall being provided on the side nearest the light source with a surface which carries ribs for holding accessories or support frames.

9. A lighting device according to claim 8, wherein the framing wall is provided on the side nearest the light source with a reflecting surface so shaped as to direct the incident light in the forward direction.

10. A lighting device according to claim 8, wherein the framing wall is made up of at least one sectional member.

11. A lighting device according to claim 8, comprising in addition a top side pivotally mounted on a hinge and a bottom side which delimits a portion containing electrical connection accessories, electrical connections and sockets for tubular lamps.

12. A lighting device according to claim 9 comprising in a central zone of the reflecting surface a through-tube for fixing a stick of an umbrella reflector or diffuser.

13. A lighting device according to claim 8, further including pivoting clamps adapted to support orientable flaps, a mount for a lens or objective, and screens, on at least certain edges of its front opening.

14. A lighting device comprising an assembly of at least two modular reflector elements, each reflector element having a front face, a rear face, and housing at least one elongated light source such as a cylindrical tubular lamp, each reflector element being provided with a reflecting surface on the front face which is directed towards the light source, with a series of ribs on the rear face and with lateral edge members, said lateral edge members being formed by end ribs and being rearwardly inclined towards each other and with respect to a front plane, said reflector elements being contiguous and attached to each other by means of a series of connecting members which are adapted to cooperate with grooves or holes carried by the reflector elements.

15. The lighting device according to claim 14, wherein the reflecting surface which results from the assembly of the reflector elements has a convex shape.

16. The lighting device according to claim 14, wherein the reflecting surface which results from the assembly of the reflector elements has a concave shape.

* * * * *